US009351086B2

(12) United States Patent
Petersen et al.

(10) Patent No.: US 9,351,086 B2
(45) Date of Patent: May 24, 2016

(54) HEARING AID DEVICE WITH IN-THE-EAR-CANAL MICROPHONE

(71) Applicant: Oticon A/S, Smørum (DK)

(72) Inventors: Svend Oscar Petersen, Smørum (DK); Pauli Minnaar, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 14/472,740

(22) Filed: Aug. 29, 2014

(65) Prior Publication Data

US 2015/0063612 A1 Mar. 5, 2015

(30) Foreign Application Priority Data

Sep. 2, 2013 (EP) ..... 13182581

(51) Int. Cl.
*H04R 25/00* (2006.01)

(52) U.S. Cl.
CPC ..... *H04R 25/50* (2013.01); *H04R 25/453* (2013.01); *H04R 25/405* (2013.01); *H04R 2225/023* (2013.01)

(58) Field of Classification Search
CPC .... H04R 25/30; H04R 25/305; H04R 25/407; H04R 25/45; H04R 25/453; H04R 2460/09; H04R 2225/023
See application file for complete search history.

(56) References Cited

U.S. PATENT DOCUMENTS 5,033,090 A * 7/1991 Weinrich ..... H04R 25/453 381/318
6,072,884 A * 6/2000 Kates ..... H04R 25/453 381/318
6,275,596 B1 * 8/2001 Fretz ..... H04R 25/652 381/321
7,330,557 B2 * 2/2008 Fischer ..... H04R 25/407 381/313
7,940,946 B2 * 5/2011 Caldarola ..... H04R 25/656 181/130

(Continued)

FOREIGN PATENT DOCUMENTS

EP 1351544 A2 10/2003
EP 1919255 A2 5/2008
EP 2200343 A1 6/2010

OTHER PUBLICATIONS

Search Report issued in European priority application 13 18 2581, dated Oct. 29, 2013.

*Primary Examiner* — Curtis Kuntz
*Assistant Examiner* — Ryan Robinson
(74) *Attorney, Agent, or Firm* — Birch, Stewart, Kolasch & Birch, LLP

(57) ABSTRACT

A hearing aid device is disclosed. The hearing aid device comprises a receiver configured to be arranged in the ear canal. The hearing aid device comprises a directional microphone system comprising two microphones or one microphone having two sound inlets. The hearing aid device comprises means for counteracting acoustic feedback on the basis of sound signals detected by the two microphones or the two sound inlets. The hearing aid device comprises an "open fitting" providing ventilation. The two microphones or the two sound inlets of the directional microphone (forming part of a directional system) are arranged in the ear canal at the same side of the receiver and sound is allowed to propagate freely between the microphones or between the inlets of the directional microphone and the receiver. Preferably, the hearing aid device comprises a procedure (such as an adaptive procedure) for optimizing the directional system of the hearing aid device. An improved feedback reduction is thereby achieved, while allowing a relatively large gain to be applied to the incoming signal.

20 Claims, 6 Drawing Sheets

(56) References Cited

U.S. PATENT DOCUMENTS

| | | | | |
|---|---|---|---|---|
| 8,130,992 | B2 * | 3/2012 | Munk | H04R 25/453 381/318 |
| 8,885,860 | B2 * | 11/2014 | Djalilian | H04R 25/606 181/128 |
| 2007/0009106 | A1 | 1/2007 | Tilson et al. | |
| 2007/0030990 | A1 | 2/2007 | Fischer | |
| 2008/0031477 | A1 | 2/2008 | Von Buol et al. | |
| 2010/0150385 | A1 * | 6/2010 | Sporer | H04R 25/405 381/313 |
| 2010/0254555 | A1 * | 10/2010 | Elmedyb | H04R 25/453 381/318 |

* cited by examiner

HEARING AID DEVICE WITH IN-THE-EAR-CANAL MICROPHONE

FIELD OF INVENTION

The present disclosure generally relates to a hearing aid device configured to reduce acoustic feedback. The disclosure more particularly relates to a hearing aid device with at least one microphone and a receiver arranged in the ear canal.

PRIOR ART

The sound in the ear canal contains all the information needed as input to the auditory system, including spatial aspects. Accordingly, the best position for placing a hearing aid device microphone in order to record sound is in the ear canal. Behind-the-ear (BTE) hearing aid devices typically have a microphone or a pair of microphones configured to be arranged on the top of the ear or behind the ear of the user of the hearing aid device. Such arrangement is established in order to counteract the acoustic feedback that occurs when a large gain is applied in the hearing aid device.

The disadvantage of having the microphones located at the top of the ear, is that the function of the pinna, which is especially important for localisation of sound, is essentially not taken into account when capturing the sound. Accordingly, the sound input to the auditory system by the hearing aid system does not contain information provided by the pinna.

Other types of hearing aid devices on the market, such as in-the-ear (ITE), in-the-canal (ITC) and completely-in-canal (CIC) hearing aid devices have microphones arranged close to the ear canal entrance. In principle, the spatial properties of sound are captured more accurately with these microphones. Unfortunately, these hearing aid devices are typically not configured to provide a large gain due to the fact that the use of them is associated with a risk of generating feedback.

In order to reduce or prevent feedback, the ear canal has to be sealed (occluded), e.g. with a mould or housing and the size of the vent is normally quite small. It is well known that these moulds/housings are uncomfortable to wear for longer time periods. Furthermore, the limited ventilation causes an unpleasant occlusion effect. For this reason the trend goes towards "open fittings" such as a receiver in the ear in combination with a large (effective) vent.

US 2007030990 A1 discloses a hearing device with low feedback tendency with simultaneous open feed and utilization of the natural directional effect of the pinna. The hearing device has a tube-shaped ear fitting piece for insertion into an auditory canal, a speaker arranged in the ear fitting piece, and at least two microphones are arranged in the ear fitting piece acoustically-symmetrically to the speaker in the built-in state of the hearing device in the ear fitting piece. The sound emitted by the speaker can be differentiated from the usable sound, such that the level of feedback can be reduced. At the same time, open feed and utilization of the natural directional effect of the pinna are ensured. The microphones are placed at each side of the receiver. This construction is not suitable for being used within the scope of the present invention.

EP 1351544 A2 discloses a directional microphone system that includes a front microphone, a rear microphone, a low-noise phase-shifting circuit and a summation circuit. The front microphone generates a front microphone signal, and the rear microphone generates a rear microphone signal. The low-noise phase-shifting circuit implements a frequency-dependent phase difference between the front microphone signal and the rear microphone signal to create a controlled loss in directional gain and to maintain a maximum level of noise amplification over a pre-determined frequency band. The summation circuit combines the front and rear microphone signals to generate a directional microphone signal. The suggested solution is used to control the directional sensitivity, whereas the scope of the present invention is to eliminate the acoustic feedback.

US2010150385A1 deals with feedback prevention by arranging a directional microphone comprising two electrically interconnected microphones, and a receiver along a straight line. The directional effect of the directional microphone is set such that, when viewed from the directional microphone, the receiver is arranged in the direction of the lowest sensitivity of the directional microphone.

The current solutions are not optimal. Either an open fitting is used in combination with microphones in the wrong position (on top of the ear) or the microphone at the ear canal entrance is used with a wrong fitting (small vent—introducing occlusion).

Previous attempts of recording sound in the ear canal with a single microphone in combination with an open fitting (large vent) has encountered difficulties. The excessive feedback of the sound reproduced by the hearing aid limits the insertion gain that can be obtained—making such a system less attractive.

Thus there is need for a hearing aid device that reduces or even eliminates these drawbacks of the prior art.

SUMMARY OF THE INVENTION

It is an object of the present disclosure to provide a hearing aid device that is comfortable to wear and provides the user of the hearing aid device with an improved sound with less feedback than the prior art hearing aid devices. It is a further object to provide an alternative solution to solutions of the prior art.

It is also an object of the present disclosure to provide a small sized hearing aid device capable of providing natural sound with a lower noise level than the traditional hearing aid devices.

An object of the present disclosure can be achieved by a hearing aid device as defined in claim 1. Preferred embodiments are defined in the dependent claims and explained in the following description and illustrated in the accompanying drawings.

In an aspect, a hearing aid according to the present disclosure is a hearing aid device comprising a receiver configured to be arranged in the ear canal, where the hearing aid device comprises a directional microphone comprising two microphones, termed a front and a rear microphone, respectively, or one microphone having two sound inlets, termed a front and a rear sound inlet, respectively, where the hearing aid device comprises a feedback suppression system for counteracting acoustic feedback on the basis of sound signals detected by the directional microphone, and where the hearing aid device comprises an "open fitting" providing a vent. The two microphones or the two different sound inlets of the directional microphone are arranged in the ear canal at the same side of the receiver and sound is allowed to propagate between the microphones or between the inlets of the directional microphone and the receiver.

Hereby a hearing aid device that is comfortable to wear is achieved. Moreover, embodiments of the hearing aid device provides the user of the hearing aid device with an improved sound with less feedback than the prior art hearing aid devices.

Moreover, it is possible to provide a small hearing aid device capable of providing natural sound with lower noise than the traditional hearing aid devices (using directional processing).

The receiver may be any type of receiver suitable for being arranged in the ear canal.

In the present disclosure, the term 'receiver' is generally used for a loudspeaker' as is customary in the field of hearing aid devices. The term loudspeaker is occasionally used in the disclosure, though, with no intended difference in meaning.

The phrase 'the (two) microphones or the (two) different sound inlets of the directional microphone are arranged in the ear canal at the same side of the receiver' is in the present context taken to mean at the same side of the receiver 'when viewed along a longitudinal direction of the hearing aid device' (or the part of the hearing aid device wherein the mentioned items are located). When the hearing aid device is operationally located in the ear canal, the microphones/sound inlets are preferably located on the same side of the receiver in the sense that they are located (as far as, or) farther away from the eardrum than the receiver (in a direction of the opening of the ear canal towards the surroundings). In an embodiment, one of the microphones (e.g. termed a rear microphone) is located adjacent to (next to) the receiver, e.g. to provide that they have their respective sound inlet and outlet in the same plane, in equal distance from the eardrum when operationally mounted in the ear canal.

The hearing aid device comprises either a directional microphone having two sound inlets that lead the sounds to opposite sides of the membrane of the microphone or a directional microphone comprising two microphones.

In the case that the hearing aid device comprises two microphones, these may be of any suitable type, size and shape. The two microphones may be identical or be different.

In the case that the hearing aid device comprises a directional microphone having two different sound inlets, the directional microphone may be of any suitable type, size and shape.

In an embodiment, the directional microphone comprises a MEMS-microphone. In an embodiment, the front and/or rear microphone(s) comprise(s) a MEMS-microphone. This allows to implement ultra-small dimensions, e.g. small distances between a front and rear microphone inlet.

The hearing aid device comprises a feedback suppression system for counteracting acoustic feedback on the basis of sound signals detected by the two microphones or the directional microphone having two different sound inlets. Such feedback suppression system may include a processing unit comprising a processor or any other suitable means, e.g. a variable, e.g. adaptive, filter.

In an embodiment, the feedback suppression system comprises a delay unit for delaying the rear microphone signal picked up by the rear microphone and a combination unit for subtracting the delayed rear microphone signal from the front microphone signal picked up by the front microphone.

In an embodiment, the feedback suppression system comprises a feedback estimation unit for estimating an acoustic feedback from the receiver to one or both of the front and rear microphones or to the front and/or rear sound inlets of a directional microphone. It may be preferable that the feedback can be estimated separately to the rear and front microphones/inlets.

By the term "open fitting" is e.g. meant a dome with ventilation apertures or a mould (an ear mould) or housing with a large vent or any other suitable type of fitting providing ventilation, such as an open dome. An 'open fitting' may be taken to include an ear canal part (e.g. comprising a dome or a mould or a housing), which, when mounted in the ear canal, provides an effective opening (ventilation area) relative to the cross sectional area of the ear canal (at the location of the ear canal part) of more than 5%, such as more than 10%, such as more than 25%, such as more than 50%. The effective opening may e.g. be larger than 2 $mm^2$, such as larger than 3 $mm^2$, such as larger than 4 $mm^2$. A 'large vent' is in the present context taken to mean a vent with an effective cross sectional area larger than 2 $mm^2$, such as larger than 3 $mm^2$, such as larger than 4 $mm^2$. In an embodiment, the term "open fitting" is taken to mean that the microphones do not obstruct the ear canal more than the dome or mould or housing itself does. In other words, a vent in the mould may define the acoustical 'openness' of the ear, and the microphones do not decrease this further. Preferably, a microphone inlet is intended to be accessible to acoustic sound.

It may be an advantage that the hearing aid device comprises a receiver configured to be arranged in the ear canal, where the hearing aid device comprises two microphones, where the hearing aid device comprises a feedback suppression system for counteracting acoustic feedback on the basis of sound signals detected by the two microphones, where the hearing aid device comprises an "open fitting" providing ventilation (e.g. in the form of a vent) and where the two microphones are arranged in the ear canal at the same side of the receiver and where sound is allowed to propagate between the microphones and the receiver. Preferably, the microphones and the loudspeaker (receiver) are placed in the ear canal in such a way that sound is allowed to propagate (freely) past the microphones.

In an embodiment, the hearing aid device comprises a front microphone and a rear microphone. Preferably, the front microphone is located farther away from the eardrum (closer to the opening of the ear canal) than the rear microphone. In an embodiment, the hearing aid is adapted to allow the front microphone to be located in the ear canal or around the opening of the ear canal (such as less than 5 mm on the outer side of the opening of the ear canal), when the hearing aid is operationally mounted.

In the present context, an 'opening of the ear canal' is or can be taken to mean a substantially plane surface containing a closed curve constituted by the points on the skin of the ear where the walls of the ear canal begins to (macroscopically) diverge (when moving from the eardrum and outwards). The closed curve may be manipulated by (statistical) fitting techniques (e.g. linear regression) to provide the plane curve most closely representing the original curve.

It may be beneficial that the hearing aid device comprises a mould or housing provided with a front microphone and a rear microphone, where the mould or housing is configured to be inserted into the ear canal in such a way that the receiver—or at least the sound outlet of the receiver—is arranged closer to the eardrum than the rear microphone and that the rear microphone is arranged between the receiver and the front microphone. In an embodiment, the front microphone is located on the mould or housing so that—it is fully in the ear canal, when the mould or housing is operationally mounted in the ear canal. Alternatively, the front microphone is located on the mould or housing so that it is located is located in the concha part of pinna around the opening of the ear canal (such as less than 5 mm on the outer side of the opening of the ear canal).

Such hearing aid device can be shaped in a compact and reliable construction.

In general, the hearing aid device is assumed to contain such detectors that are relevant for the functionality of the hearing aid device as described in the present disclosure. In an embodiment, the hearing aid device comprises a level detector (LD) for determining the level of an input signal (e.g. on a band level and/or of the full (wide band) signal). In a particular embodiment, the hearing aid device comprises a voice detector (VD) for determining whether or not an input signal comprises a voice signal (at a given point in time). In an embodiment, the hearing aid device comprises an own voice detector for detecting whether a given input sound (e.g. a voice) originates from the voice of the user of the system. In an embodiment, the hearing aid device comprises a noise detector. In an embodiment, the hearing aid device comprises a signal to noise ratio detector (estimator). Noise level estimation and/or SNR estimation may e.g. be performed in combination with a voice activity detector (VAD). In an embodiment, the hearing aid device comprises a feedback detector for (dynamically) determining frequencies or frequency bands where substantial feedback (e.g. howl) occur, or having a substantial risk of resulting in feedback howl at a given point in time (e.g. in that the level of feedback is estimated to be above a certain threshold level).

It may be beneficial that the microphones or sound inlets are arranged in such a manner that the acoustic feedback received at the rear microphone or the rear sound inlet exceeds the acoustic feedback received at the front microphone or the front sound inlet by at least 3 dB, preferably 4-6 dB when the hearing aid device is arranged in a normal ear canal.

Preferably, the hearing aid device is arranged to provide that sound in the ear canal can be considered either as incoming (coming from outside) or outgoing (coming from the ear canal/eardrum side). A goal of the hearing aid device is to reduce (preferably cancel) the outgoing sound while the incoming sound is left (substantially) unchanged. This can be achieved by using two microphones (front and rear) in a directional system, which delays the rear microphone signal (picked up by the rear microphone located relatively close to the eardrum) and subtracts it from the front microphone signal (picked up by the front microphone located relatively farther away from the eardrum).

This allows a very effective suppression of the acoustic feedback in the directional microphone signal with only moderate effect on the amount of external signal in the directional microphone signal. The propagation delay of acoustic feedback between the inlets can be compensated for by delaying the rear microphone output accordingly. The level difference is compensated for by amplifying the front microphone output by a predefined amount, e.g. 3 dB or 4-6 dB or more, more than the rear microphone output (or correspondingly attenuating the rear microphone signal relative to the front microphone signal). Preferably, the front and rear microphones are matched to provide a predefined attenuation of the rear microphone signal relative to the front microphone signal (when the hearing aid device is operationally mounted in the ear canal and the sound signal arrives from the eardrum (feedback)) Preferably, the predefined attenuation is adapted to compensate the attenuation of a (feedback) signal propagating from the eardrum between the rear and the front microphone. The acoustic feedback signal would then be equal in the two branches entering the sum-unit (see FIG. 5). For external signals, the difference in amplification ensures that there are no frequencies where the phase difference between the sounds at the inlets would cause a complete cancelling. Accordingly, the hearing aid device according to the disclosure has a close to perfect omnidirectional characteristic for external signals.

It may be an advantage that the hearing aid device has one directional microphone (with a rear and a front inlet) and that a dampening material is provided in the fluid channel leading from the rear inlet to the microphone diaphragm in order to provide a passive attenuation of 3 dB or more, such as 4-6 dB. It may be preferred that the fluid channel leading from the rear inlet (to the microphone diaphragm) is configured to have a longer acoustic delay than the channel from the front inlet (to the microphone diaphragm).

In an embodiment comprising a dome, it may be beneficial that the rear sound inlet is arranged between the dome and the eardrum (i.e. on the inner side of the dome, the inner side being the side facing the eardrum, when the hearing aid device is operationally mounted).

It may be advantageous that the hearing aid device comprises a dome or an ear mould or a housing provided with one or more ventilation apertures, where the sum of the cross-sectional area(s) of the ventilation apertures is at least 5%, preferably at least 10%, such as 20% of the cross-sectional area of the ear canal so that:

$$\sum_i a_i \geq 0.05A,$$

where $a_i$ is the cross-sectional area of the i'th ventilation aperture and where A is the cross-sectional area of the ear canal.

Hereby it is ensured that sufficient ventilation (enough to avoid occlusion) is provided.

The cross-sectional area of "the ear canal" is referred to as the cross-sectional area of an ear canal into which the actual hearing aid device is intended to be inserted. This means that a hearing aid device for a child typically would have a smaller cross-sectional area than in the case of a hearing aid device intended for a grown-up person.

It may be beneficial that the hearing aid device comprises a dome or an ear mould or housing and that the hearing aid device comprises a front microphone and a rear microphone, and that the rear microphone is arranged on the inner side of the dome or the ear mould or housing, and that the rear microphone is arranged adjacent to the receiver.

This will increase the level differences for signals received by the two microphones. Hereby the signal-to-noise ratio for the external sound field will be improved.

It may be advantageous that the hearing aid device comprises a rear microphone and a receiver that are integrated in one unit, preferably a one-piece body.

In an embodiment, the front microphone is located on the outer side of the dome or the ear mould or housing (the outer side being the side facing the surroundings (away from the eardrum), when the hearing aid device is operationally mounted).

In an embodiment, the front microphone is separate unit that is electrically connected to a processing unit of the hearing aid device, but not part of the unit comprising the rear microphone and/or the receiver.

It is possible to use a directional microphone with two sound inlets (one on each side of the microphone diaphragm). It may be an advantage that the sound inlets are designed to achieve a general optimum level and phase difference by appropriately optimising (designing) the length and the opening of the inlets.

In general, a housing or mould of the hearing aid device may have any form and be portioned in a number of different parts or separate bodies. In an embodiment, the housing or mould (comprising one or more parts or bodies) of the hearing aid has a longitudinal extension comprising a central substantially straight line axis. In an alternative embodiment, the housing or mould (comprising one or more parts or bodies) extends along a non-linear axis. In an embodiment, the front and rear microphones (or front and rear sound inlets) and the receiver are not located on a straight line. It may, e.g., be beneficial that the hearing aid device comprises a housing having a first portion and a second portion, where each of the two portions are basically box-shaped or cylindrical and where the longitudinal axis of the first portion is angled (e.g. 150, 160 or 170 degrees) relative to the longitudinal axis of the second portion and where the housing has a geometry that fits the anatomy of the ear canal.

Such construction is user-friendly, easy to insert in the ear canal and easy to remove from the ear canal.

It may be an advantage that the first portion comprises a front microphone and a rear microphone and that the receiver is housed in the second portion. Alternatively, the rear microphone may also be housed in the second portion. In both cases, the front and rear microphones and the receiver are not located on a straight line (but reflect the angle between first and second portion of the housing). In such configuration, a procedure for optimisation of the directional system is particularly advantageous (see below).

In general, the design (including form, partition and size) of the housing or mould is preferably adapted to provide that incoming sound signals are allowed to propagate (freely) past the microphones towards the receiver.

It may be advantageous that the hearing aid device comprises a pull-out string attached to the housing. Alternatively, other mounting or removal elements may be used, e.g. via a connecting element to a part located outside the ear canal or using a separate tool.

The pull-out string may ease the insertion of the hearing aid device into the ear canal and ease the removal of the hearing aid device from the ear canal.

The pull-out string may be attached to the proximal end of the housing (the proximal (or outer) end facing the surroundings (away from the eardrum), when the hearing aid device (including the housing) is operationally mounted).

It may be beneficial that the pull-out string extends basically along the axis of the (outer) end of the housing to which the pull-out string is attached.

Preferably, the pull-out string is adapted to minimize the disturbance of the incoming sound field. In an embodiment, the pull-out string is a longitudinal, flexible element. In an embodiment, the longitudinal, flexible element is sufficiently thin in cross-section to be largely invisible and/or adapted to be sufficiently loose or slack to hang down from the opening of the ear canal substantially governed by the force of gravity.

It may be beneficial that the hearing aid device comprises a hollow attachment member attached to the housing, which attachment member is configured to receive and hereby be mechanically attached to a dome.

Hereby a reliable and easy attachment of a dome to the hearing aid device can be provided.

It may an advantage that the attachment member extends as extension to the housing at the distal end of the housing. Hereby a user friendly hearing aid device that fits the anatomy of the ear can be provided.

It may be beneficial that an annular attachment flange is provided at the distal (inner) end of the attachment member. The attachment member is preferably configured to receive and hereby be mechanically attached to a dome.

As previously mentioned, the hearing aid device may preferably comprise directional system comprising a rear microphone and a front microphone arranged to provide an attenuation of the rear microphone of 3 dB or more, preferably 4-6 dB (or more) relative to the front microphone. It may be beneficial that the hearing aid device comprises two (e.g. omni-directional) microphones or a directional microphone having two different sound inlets and that the hearing aid device is configured to and comprises a (e.g. automatic) procedure for optimising the directional system of the hearing aid device. In an embodiment, the procedure of optimising the directional system is dynamic (adaptive).

In an embodiment, the procedure for optimising the directional system of the hearing aid device comprises playing a pure tone or a sweep tone or a broad band noise from the receiver (e.g. generated in a processing unit) and detecting the level difference between the signals received by the two microphones or the two sound inlets, in order to provide a perfect level match. The procedure preferably includes (using the same signal) to detect the delay difference between the two microphones or between the two sound inlets of the directional microphone.

The optimisation (or calibration) can e.g. be performed once by a hearing care professional (during a fitting procedure). Alternatively, the hearing aid device can be configured to perform the procedure every time the hearing aid device is placed in the ear canal (e.g. automatically every time the device is powered on, and/or initiated by a user via an activation element on the device or via a remote control).

It may be advantageous that the hearing aid device comprises two microphones or a directional microphone having two different sound inlets and that the hearing aid device is configured to and comprises means for optimising the directional system of the hearing aid device by using a feedback unit to estimate a transfer function from an emitted signal to the receiver to the received signal from each microphone input or from each sound inlet to estimate the difference in both sound level and delay and/or phase.

The information provided by using the feedback unit can be applied to update the delay (by using a delay unit) and gain (by using an amplifier).

It may be beneficial that the hearing aid device is configured to and comprises means for optimising the directional system of the hearing aid device by detecting the power in the directional microphone signal and minimising the total signal power in the directional microphone signal.

By using an adaptive routine it is possible to adjust the delay and gain in order to minimise the total signal power in the directional microphone signal. Since the acoustic feedback contributes (at times significantly) to the total signal power, it is possible to use this parameter to optimise the directional system.

It may be an advantage that the hearing aid device is configured to ensure that the signal power in the directional microphone signal is adaptively minimized by varying gain and/or delay in the signal path from the rear and/or front inlets. The adaptation is preferably made with the constraint that the sensitivity towards external sounds is not compromised. This may be achieved by using any suitable technique, such as e.g. a General Sidelobe Canceller (GSC) or a Minimum Variance Distortionless Response (MVDR) beamformer on the microphone output signals. Minimising the signal power will effectively reduce the amount of acoustic feedback in the directional microphone signal, because the total signal power in the directional microphone is close to a sum of the signal power contributed by external signal and the signal power contributed by the acoustic feedback. Typically, an adaptive algorithm form part of the minimization process.

Preferably, the adaptive algorithm comprises a prediction error algorithm. A frequently used adaptive algorithm in state of the art hearing aid devices is an LMS (Least Means Squared) algorithm, a normalized least mean square (NLMS)

algorithm. Other algorithms may be used, however, see e.g. [Haykin; 2001] (S. Haykin, Adaptive filter theory (Fourth Edition), Prentice Hall, 2001).

It may be an advantage that the hearing aid device is configured to and comprises means for optimising the directional system of the hearing aid device in predefined frequency bands.

The described optimising methods can be processed in separate frequency bands in order to minimise the acoustic feedback in the entire frequency range. Hence, the hearing aid device comprises in such embodiment an analysis filter bank for splitting a time variant input signal in a number of (time variant) frequency band signals, and correspondingly a synthesis filter bank for synthesizing a time variant output signal from a number of (time variant) frequency band signals. Besides, this way of optimising the directional system according to the disclosure makes it possible only to optimise the directional system in the frequency bands, in which the feedback is a problem. In such case, the hearing aid device may comprise a feedback detector for detecting frequency band(s) currently at risk of experiencing howl due to feedback. Alternatively, such frequency band(s) that are prone to feedback howl may be determined in advance.

The hearing aid device according to the disclosure provides a natural sound due to the arrangement of the microphone(s) in the ear canal. It is possible to provide a hearing aid device that generates less noise (e.g. lower wind noise) than traditional hearing aid devices.

In the present context, a "hearing aid device" refers to a device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears.

A hearing aid device may comprise a single unit or several units communicating electronically with each other. More generally, a hearing aid device comprises an input transducer for receiving an acoustic signal from a user's surroundings and providing a corresponding input audio signal and/or an 'input receiver' for electronically receiving an input audio signal, a signal processing circuit for processing the input audio signal and an output means for providing an audible signal to the user in dependence on the processed audio signal. Some hearing aid devices may comprise multiple input transducers, e.g. for providing direction-dependent audio signal processing.

In some hearing aid devices, the input receiver may be a wireless receiver. In some hearing aid devices, the input receiver may be e.g. an input amplifier for receiving a wired signal. In some hearing aid devices, an amplifier may constitute the signal processing circuit. In some hearing aid devices, the output means may comprise an output transducer, such as e.g. a receiver (loudspeaker) for providing an air-borne acoustic signal. In an embodiment, the hearing aid device is specifically adapted to provide that some of, such as a substantial part of, e.g. a majority of, or all, signal processing is performed outside the part of the hearing aid device adapted for being located in the ear canal, e.g. in a part adapted for being located behind the ear. In a hearing aid device according to the present disclosure, this has the advantage that (as opposed to current BTE hearing aids comprising one or more microphones) the processor can be made very small and can be hidden completely behind the ear since it does not contain microphones that have to be "visible".

A "hearing system" refers to a system comprising one or two hearing aid devices, and a "binaural hearing system" refers to a system comprising one or two hearing aid devices and being adapted to cooperatively provide audible signals to both of the user's ears. Hearing systems or binaural hearing systems may further comprise "auxiliary devices", which communicate with the hearing aid devices and affect and/or benefit from the function of the hearing aid devices. Auxiliary devices may be e.g. remote controls, remote microphones, audio gateway devices, mobile phones (e.g. SmartPhones), public-address systems, car audio systems or music players. Hearing aid devices, hearing systems or binaural hearing systems may e.g. be used for compensating for a hearing-impaired person's loss of hearing capability, augmenting or protecting a normal-hearing person's hearing capability and/or conveying electronic audio signals to a person.

DESCRIPTION OF THE DRAWINGS

The disclosure will become more fully understood from the detailed description given herein below. The accompanying drawings are given by way of illustration only, and thus, they are not limitative of the present disclosure. In the accompanying drawings.

DETAILED DESCRIPTION OF THE INVENTION

Figure 1A:
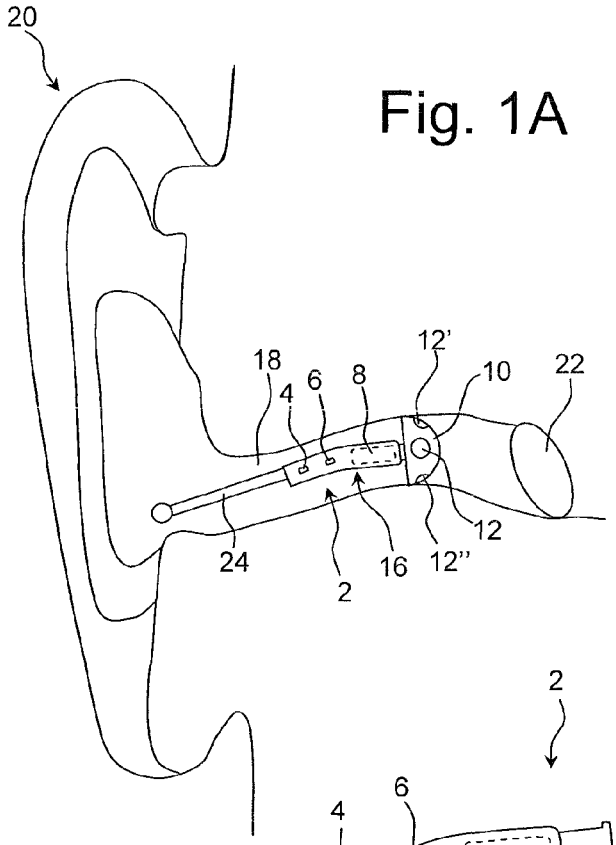
FIG. 1A shows a schematic view of a hearing aid according to the disclosure arranged in the ear canal of a user.
Figure 1B:
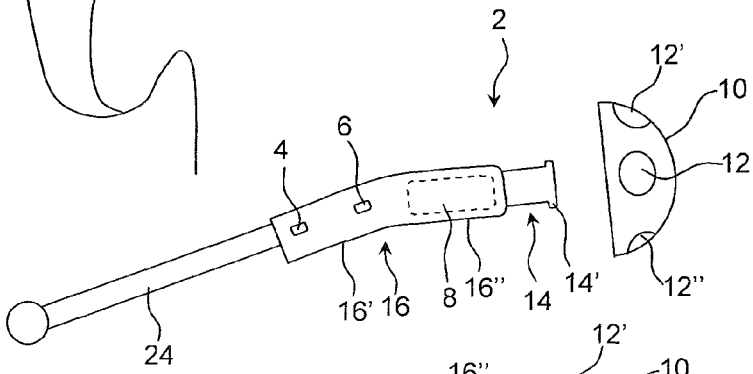
FIG. 1B shows a schematic close-up view of the hearing aid device shown in FIG. 1A.
Figure 1C:
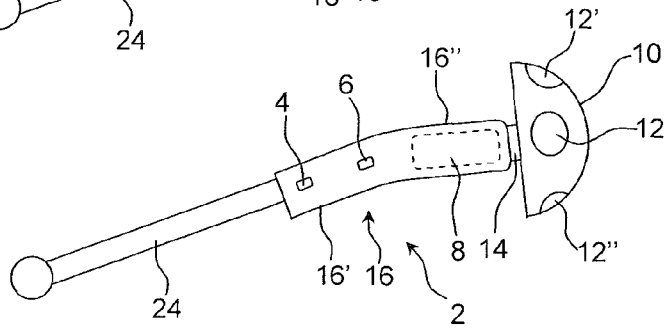
FIG. 1C shows another schematic view of the hearing aid device shown in FIG. 1A.

Referring now in detail to the drawings for the purpose of illustrating preferred embodiments of the present disclosure, different views of a hearing aid device 2 according to the disclosure is illustrated in FIGS. 1A-1C.

FIG. 1A illustrates a schematic view of a hearing aid 2 according to the disclosure arranged in the ear canal 18 of the ear 20 of a user. The hearing aid device 2 comprises a housing 16 provided with a receiver 8, a front microphone 4 and a rear microphone 6. The housing 16 also houses a processing unit having a processor (not shown) configured to process sound signals received by the microphones 4, 6. The hearing aid device 2 also comprises an amplifier that is not visible in FIG. 1A. The two microphones (4, 6) are arranged in the ear canal (18) at the same side of the receiver (8) and the sound is allowed to propagate freely past the microphones (4, 6) to the receiver (8) (and vice versa).

The hearing aid device 2 comprises a pull-out string 24 that is attached to the proximal end of the housing 16. The pull-out string 24 is configured to be used when inserting the hearing aid device 2 into the ear canal 18 and when removing the hearing aid device 2 from the ear canal 18.

A dome 10 provided with a plurality of ventilating apertures 12, 12', 12" are attached to the distal end of the housing 16. The ventilation apertures 12, 12', 12" provide ventilation that prevents occlusion. The dome 10 may be configured to be arranged in the bone region of the ear canal.

It is important to underline that FIG. 1A is only a schematic view of a hearing aid device 2 according to the disclosure arranged in the ear canal 18. The actual size and geometry of the hearing aid device 2 may be different. By way of example, it is possible to arrange the housing 16 of the hearing aid device 2 as well as the dome 10 closer to the eardrum 22 than illustrated in FIG. 1A.

FIG. 1B illustrates a schematic close-up view of the hearing aid device shown in FIG. 1A. It can be seen that the front microphone 4 and the rear microphone 6 are arranged close to one another and that they have identical shape. It is possible to apply different microphones if desired. Moreover, the microphones 4, 6 may be orientated differently if desired.

The receiver 8 is indicated with a dotted line for illustration purposes. The receiver may be arranged within the housing 16 so that it would not be visible from outside. The housing 16 is shaped to (e.g. flexibly) fit the anatomy of the ear canal 18. Accordingly, the housing comprises a first portion 16' in which the microphones 4, 6 are provided and a second portion 16" in which the receiver 8 is provided. The first portion 16' and the second portion 16" are angled slightly relative to each other in order to fit to the geometry of the ear canal 18. Alternatively, the housing 16 is configured to exhibit a substantially linear axial extension.

A cylindrical hollow attachment member 14 is attached to the proximal end of the housing 16. The attachment member 14 extends as an extension of the housing 16. An attachment flange 14' is provided at the proximal end of the attachment member 14. The attachment member 14 is configured to receive and hereby be attached to a dome 10.

In FIG. 1C the dome 10 has been detachably attached to the attachment member 14 of the hearing aid device 2. The hearing aid device 2 may be provided with other types of domes or ear moulds, however, it is essential that so-called "open fittings" capable of providing a large vent are applied.

Instead of using two microphones 4, 6, it is possible to use one directional microphone provided with two sound inlets (e.g. one at each side of the microphone diaphragm), where the sound inlets are configured to achieve the general optimum level and phase difference. This may be done by designing the length and geometry of the openings of the inlet in an appropriate way.

I would be possible to arrange the rear microphone 6 on the inner side of the dome or mould adjacent to the receiver (loudspeaker outlet). Hereby the level difference between the two microphone signals for external signals will be increased and the signal-to-noise ratio for the external field will be improved.

The rear microphone 6 may be different (e.g. smaller and/or configured to tolerate or generate more or less noise) than the front microphone 4.

It is possible to integrate the rear microphone 6 and the receiver 8 in one unit, e.g. a one-piece body.

Figure 2A:
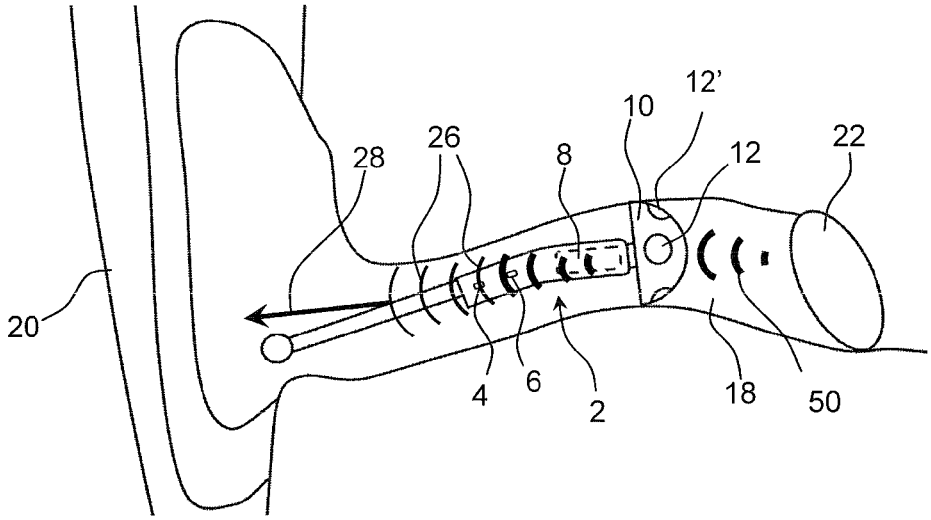
FIG. 2A indicates near field feedback sound waves generated by a receiver in a hearing aid device.

FIG. 2A illustrates a schematic view of a hearing aid device 2 according to the disclosure arranged in the ear canal 18 of the ear 20 of the user of the hearing aid device 2. The hearing aid device 2 comprises a dome 10 arranged close to the eardrum 22. The hearing aid device 2 also comprises a front microphone 4 and a rear microphone 6 arranged next to each other. Adjacent to the rear microphone 6, a receiver 8 is arranged.

The receiver 8 of the hearing aid device 2 emits sound through the hollow attachment member 14 (see FIGS. 1A-1C) and the dome 10 into the inner portion of the ear canal 18. Some of the emitted sound escapes or leaks (e.g. due to reflection from the eardrum and other parts of the 'residual volume' between dome and eardrum, as schematically indicated in FIG. 2A by 'sound source' 50) as acoustic feedback through the vents 12, 12' in the dome 10 and reaches the sound inlets (microphones) 4, 6, thereby creating a feedback loop. The leakage sound is directed outwardly (towards the environment, away from the eardrum), which is indicated with an arrow 28 indicating the outwards direction. The leaked sound waves 26 are detected within the near field by the microphones 4, 6 that receive and amplify the signal. The hearing aid device 2 according to the disclosure is configured to reduce or even eliminate the feedback sound waves 26 generated by the receiver 8 of the hearing aid device 2, thus the disclosure may cancel or reduce the effect that the acoustic feedback has on the directional microphone signal.

The sound pressure level from the receiver 8 at the rear microphone 6 is higher than the sound pressure level at the front microphone 4. This is indicated by the "thickness" of the arced lines indicating the sound waves 26. It can be seen that the "thickness" of the sound waves 26 decreases as a function of the distance to the receiver 8.

Figure 2B:
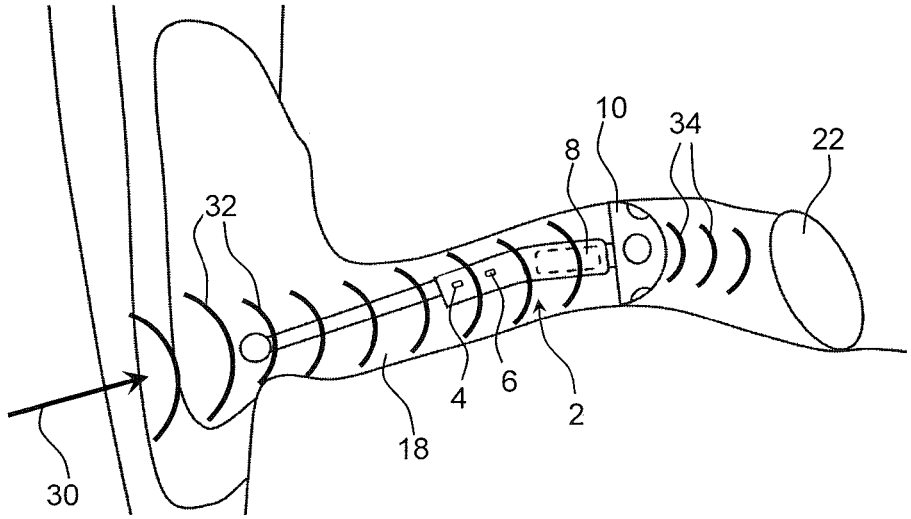
FIG. 2B shows how external sound waves are detected by the microphones of the hearing aid device.

FIG. 2B illustrates a schematic view of the hearing aid device 2 shown in FIG. 2A arranged in the ear canal 18 of the ear 20 of the user of the hearing aid device 2. The hearing aid device 2 comprising a dome 10 arranged close to the eardrum 22. The front microphone 4 and the rear microphone 6 of the hearing aid device 2 detects external sound waves 32 (far field sound waves) having an inwards direction 30, which is indicated by the arrow 30.

The external sound waves 32 picked up by the front microphone 4 and the rear microphone 6 of the hearing aid device 2 are processed by the hearing aid device 2 and the processed signal is hereafter amplified and sent to the receiver 8 that generates sound waves 34 that are directed towards the eardrum 22 of the ear 20 of the user of the hearing aid device 2. The incoming external sound waves 32 pass through the dome 10 and arrives the residual volume between the dome and the eardrum 22 (in attenuated form), where it is mixed with the processed and amplified version generated by the receiver 8.

Figure 3A:
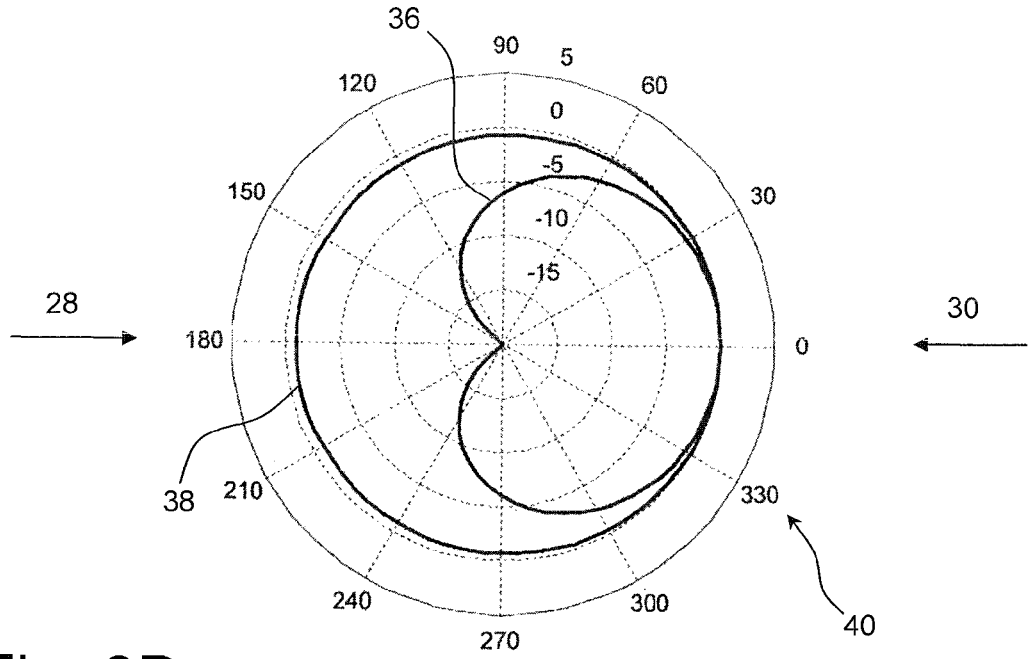
FIG. 3A shows a directional chart of near field and far field sound provided by the directional system of the hearing aid device according to the disclosure.

FIG. 3A illustrates a directional chart 40 of near field 36 sound waves and far field 38 sound waves provided by the directional system (comprising front microphone and rear microphones 4, 6) of the hearing aid device shown in FIGS. 2A-2B. The directional chart 40 shows the sound directions 28, 30 with regard to the hearing aid device setup illustrated in FIG. 2A and in FIG. 2B, respectively (i.e. flipped vertically compared to the setup of FIGS. 2A-2B).

It can be seen that the microphone system of the hearing aid device is tuned for directionality (the cardioid 36) in the near field (feedback sound, having minimum sensitivity in a direction 28 towards the ear drum, where a major part of the feedback is expected to have its origin) and that the directionality of the microphone system is basically omni-directional in the far field (the circular diagram 38) (external sound). For conventional directional microphone systems having two microphones, the sensitivity decreases at low frequencies. However, since the hearing aid device according to the disclosure applies a focused directionality in the near field, the sensitivity drop will be less significant and accordingly the signal-to-noise ratio will be improved (see FIG. 3B).

Figure 3B:
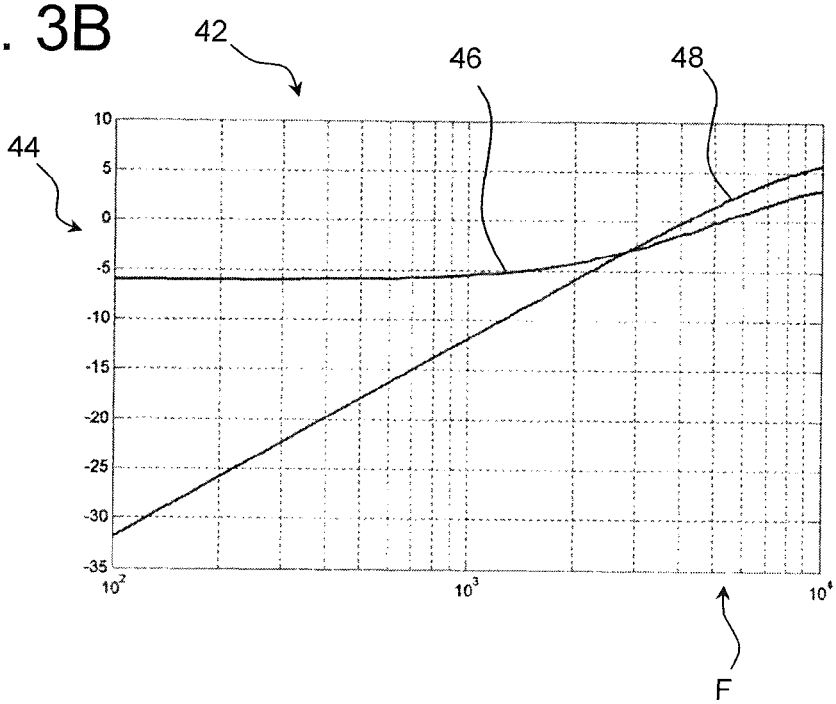
FIG. 3B shows a graph illustrating microphone noise as a function of frequency.

FIG. 3B shows a graph 42 illustrating the microphone noise 44 on a dB scale as a function of frequency F measured in Hz. The graph 42 illustrates the far field noise 46 (external sound) and the near field noise 48 (feedback) as a function of frequency F. FIG. 3B shows the difference between the microphone noise in the directional microphone signal (cardioid 36 in FIG. 3A) of a hearing aid device according to the disclosure compared to the microphone noise from a single (omni-directional characteristic, 38 in FIG. 3A) microphone assuming that two identical microphones are used in the hearing aid device.

Figure 4B:
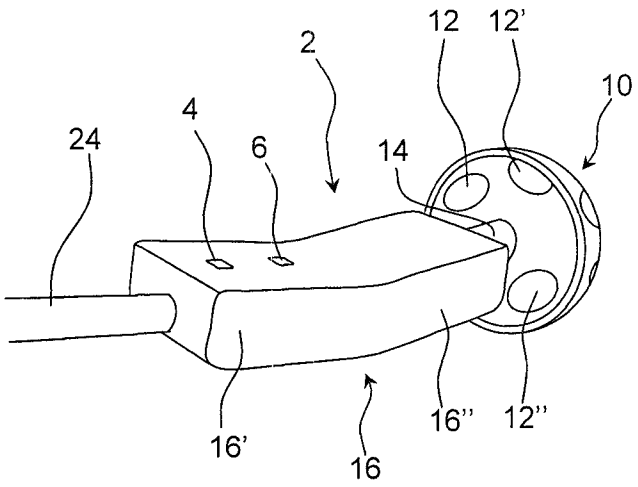
FIG. 4B shows a schematic perspective view of the hearing aid device shown in FIG. 4A with a dome with ventilation apertures.
Figure 4A:
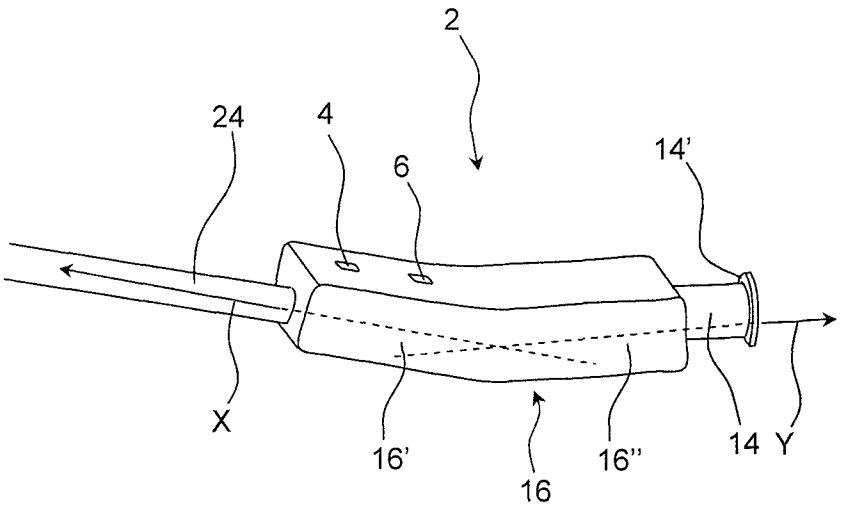
FIG. 4A shows a schematic perspective view of a hearing aid device according to the disclosure.

FIG. 4A illustrates a schematic perspective view of a hearing aid device 2 according to the disclosure. The hearing aid device 2 comprises a housing 16 having a first portion 16' and a second portion 16". Each of the two portions 16', 16" are basically box-shaped. The longitudinal axis X of the first portion 16' is angled relative to the longitudinal axis Y of the second portion 16". This construction is provided in order to make the hearing aid device 2 fit the anatomy of the ear canal 18.

A front microphone 4 and a rear microphone 6 are provided in the first portion 16' of the housing 16 of the hearing aid device 2. The front microphone 4 and the rear microphone 6 are arranged adjacent to each other. The second portion 16" of the housing 16 comprises a battery (not shown), an amplifier (not shown) and a processing unit (not shown) capable of processing the sound signals detected by the front microphone 4 and the rear microphone 6 according to a predefined scheme (e.g. to make appropriate (linear) combinations of the microphone signals as is known in the art) in order to reduce the acoustic feedback.

A cylindrical elongated pull-out string 24 is attached to the proximal (outer) end of the first portion 16' of the housing 16 of the hearing aid device 2. A hollow (pipe shaped) cylindrical attachment member 14 extends as an extension of the distal (inner) end of the second portion 16" of the housing 16 of the hearing aid device 2. An annular attachment flange 14' is provided at the distal end of the attachment member 14. The attachment member 14 is configured to receive and hereby be mechanically attached to a dome 10 as illustrated in FIG. 4B.

FIG. 4B illustrates a schematic perspective view of the hearing aid device 2 shown in FIG. 4A. A dome 10 provided with a plurality of ventilation apertures 12, 12', 12" is mechanically attached to the attachment member 14. The ventilation apertures 12, 12', 12" are configured to provide ventilation in order to prevent occlusion.

As alternative to a dome 10 like the one illustrated in FIG. 4B it is possible to apply any other type of ventilated dome or housing or mould.

Figure 5B:
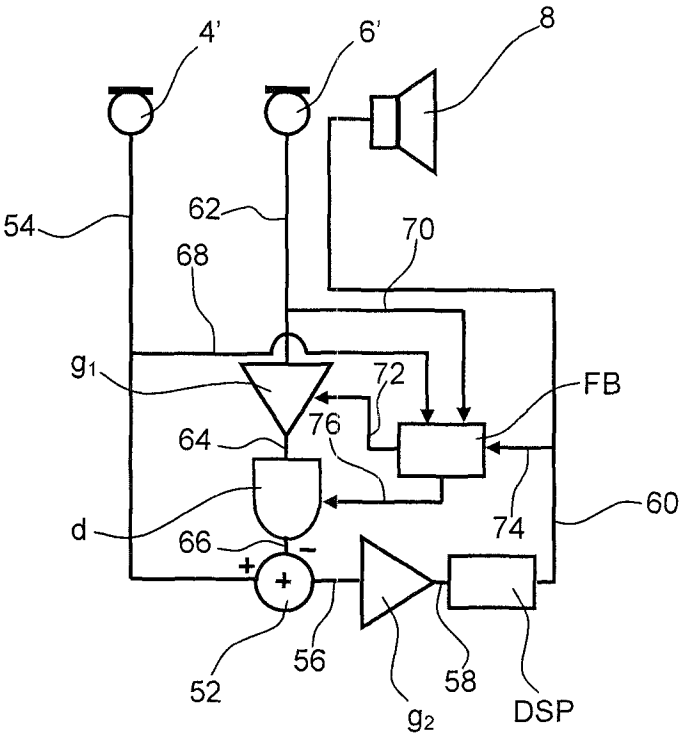
FIG. 5B shows a block diagram illustrating an implementation of the hearing aid device according to the disclosure in a setup configured to be applied while the hearing aid device is arranged in the ear canal.
Figure 5A:
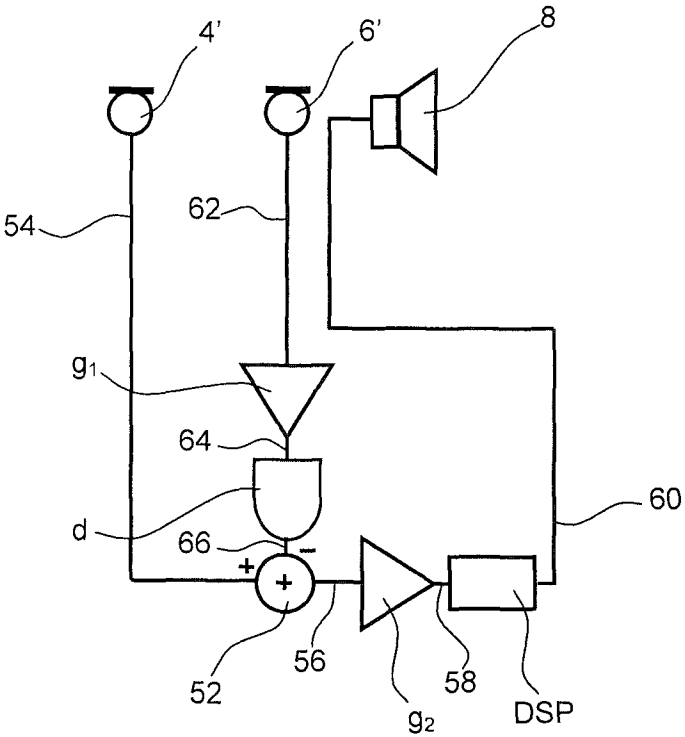
FIG. 5A shows a block diagram illustrating an implementation of the hearing aid device according to the disclosure in a feedback eliminating setup, where the hearing aid device is arranged in an ideal long tube.

FIG. 5A is a block diagram illustrating an implementation of the hearing aid device according to the disclosure in a feedback attenuating or eliminating setup, where the hearing aid device is arranged in an ideal long tube.

The block diagram illustrates a front microphone 4' and a rear microphone 6'. The front microphone 4' is electrically connected to a summation circuit 52 configured to combining the front microphone and rear microphone signals to generate a directional microphone signal. The microphone 6' is electrically connected to an amplifier $g_1$ by means of an electrical connection (e.g. a conductor) 62.

The amplified signals from the rear microphone 6' are further delayed. The delay is carried out by means of a delay unit d that is electrically connected to the amplifier $g_1$ by a conductor 64. The delay unit d is further electrically connected to the summation circuit 52 by means of an electrical conductor 66.

The directional microphone signal generated by the summation circuit 52 is fed to a second amplifier $g_2$ by means of an electrical conductor 56. The amplified signal is forwarded from the amplifier $g_2$ to a digital signal processor DSP by conductor 58. The digital signal processor is connected to a receiver 8 by means of an electrical connection 60. The receiver 8 is generating the processed sound waves that are sent towards the eardrum of the user (cf. e.g. 34 in FIGS. 2A-2B).

In the ideal case, in which the hearing aid device is arranged in an ideal long tube, it is possible to consider the sound as plane waves moving in the axial direction (e.g. 30 in FIGS. 2A-2B) of the ear canal. The acoustical feedback from the receiver can be removed by using a matched pair of microphones 4', 6' and applying a delay to the rear microphone 6', where the delay is equivalent to the time delay determined by the distance between the microphones 4', 6' and the speed of sound. A feedback free signal (at 56) can be achieved by subtracting the two signals in the summation circuit 52 as indicated in FIG. 5A.

In reality, however, the ear canal cannot be considered to be an ideal long tube. Therefore, the sound cannot be considered as plane waves moving in the axial direction of the ear canal.

In 5A, the ideal situation, the gain in the two microphone paths should be equal (assuming identical microphones) in order to cancel the plane-wave acoustic feedback. Such an arrangement would, however, also cancel out some frequencies in the external signal, namely frequencies for which the sum of the propagation delay between the microphones inlets and the additional delay of the rear microphone inlet signal equals a 180 degree phase shift. For a distance of about 1 cm between the inlets, this would occur at about 8.5 kHz. This effect is avoided when the inlets are arranged to receive the feedback with 3 dB (or more) or 4-6 dB difference.

FIG. 5B shows a block diagram illustrating an implementation of the hearing aid device according to the disclosure in a setup configured to be applied while the hearing aid device is arranged in a real ear canal.

The block diagram is basically similar to the one shown in FIG. 5A, however it has been slightly modified.

A feedback unit FB is electrically connected to the conductor 54 by a conductor 68. Hereby signals from the front microphone 4' are sent to the feedback unit FB. The feedback unit FB is further electrically connected to the conductor 62 by a conductor 70. Accordingly, signals from the rear microphone 6' are sent to the feedback unit FB.

The feedback unit FB is electrically connected to the amplifier $g_1$ by means of an electrical conductor 72 and to the delay unit d by means of an electrical conductor 76. The feedback unit FB is further electrically connected to the conductor 60 by means of an electrical conductor 74 so that signals from the digital signal processor DSP can be received in the feedback unit.

The feedback unit FB is configured to utilise all the received signals in order to reduce the acoustic feedback (by adaptively controlling amplifier $g_1$ and delay unit d).

In the real ear the sound propagating in and out of the ear canal are not entirely plane waves because of: a) the varying cross sectional area; b) the bending of the ear canal; c) the short length of the ear canal and d) the fact that the sound source 50 (cf. FIG. 2A) for acoustic feedback is relatively close to the microphones 4', 6'. To achieve the optimal cancellation or attenuation of the acoustical feedback, the microphone sensitivity level may be matched in a procedure using a signal from the receiver 8.

In practice the sound pressure level from the receiver 8 at the rear microphone 6' is higher than the sound pressure at the front microphone 4' as illustrated in FIG. 2A. Therefore, the microphone system is optimised for directionality in the near field and the directionality is essentially omni-directional in the far field (as illustrated in FIG. 3A).

There are several ways of optimising the directional system according to the disclosure:

A first option is to play a pure tone or a swept tone or a broad band noise from the receiver 8 for detection of the level difference between the two microphones 4', 6' in order to provide a perfect level match. This detection may e.g. be performed in a processing unit having access to current levels of the respective signal at 54 and 62 (e.g. embodied in the feedback unit FB). The same signal may be used to detect the delay difference between the two microphones 4', 6'. This can be done once by the hearing care professional or e.g. every time the hearing aid device is placed in the ear canal (by a specific processing unit, e.g. the feedback unit FB or equivalent).

Preferably, the hearing aid device comprises a programming interface (e.g. a wireless interface) to a fitting system. In an embodiment, the directionality system optimisation procedure is configured to be initiated from the fitting system, and results of the optimisation are processed in the fitting system, so that resulting parameters (e.g. amplification and delay) are uploaded to the hearing aid device from the fitting system via the programming interface.

Preferably, however, the hearing aid device is configured to execute the directionality system optimisation procedure automatically and/or by initiation from a user interface.

A second option is to use the feedback unit FB to estimate the transfer function from the signal emitted to the receiver 8 to the received signal from each microphone input and to estimate the difference in both level and delay/phase. The information provided by using the feedback unit FB can then be used to update the delay (of delay unit d) and gain (of amplifier $g_1$) as illustrated in FIG. 5B. This may allow automatic adaptation to changing conditions during use of the hearing aid device.

A third way of optimising the directional system according to the disclosure is to minimise the total signal power in the directional microphone signal, preferably with the constraint that the sensitivity towards signals received from the external space remains constant. By using an adaptive routine it is possible to adjust the delay and gain in order to minimise the total signal power. Since the acoustic feedback may contribute significantly to the total signal power, it is possible to use this parameter to optimise the directional system.

The above optimisation procedures are described as taking place in the time domain. The directional system according to the disclosure can, however, also be optimised by in the frequency domain (by splitting the microphone signals in a number of frequency bands, and synthesizing the frequency band signals to a time domain signal before being fed to the receiver 8). The described optimising methods can be processed in separate frequency bands in order to minimise the acoustic feedback in the entire frequency range. Besides, this way of optimising the directional system according to the disclosure makes it possible to optimise the directional system only in the frequency bands, in which the feedback is a problem.

One of the major advantages of the hearing aid device according to the disclosure is that the reduction of the feedback allows for higher insertion gain. Therefore, it is possible to achieve the benefits of the more natural microphone location effect (in the ear canal as opposed to 'behind' the ear) combined with the possibility to achieve an insertion gain close to the level that is applied in BTE and RITE hearing aid devices with corresponding vent.

Another advantage of the hearing aid device according to the disclosure is that the adaptive optimisation of the directional system accounts for the dynamic variations of the acoustic feedback caused by jaw movements or changes of leakage and effective vent in the ear canal.

An additional advantage is that occlusion sounds that are generated in the ear canal are also attenuated. Besides, an overall reduced occlusion effect is achieved for systems with smaller vents.

Figure 6B:
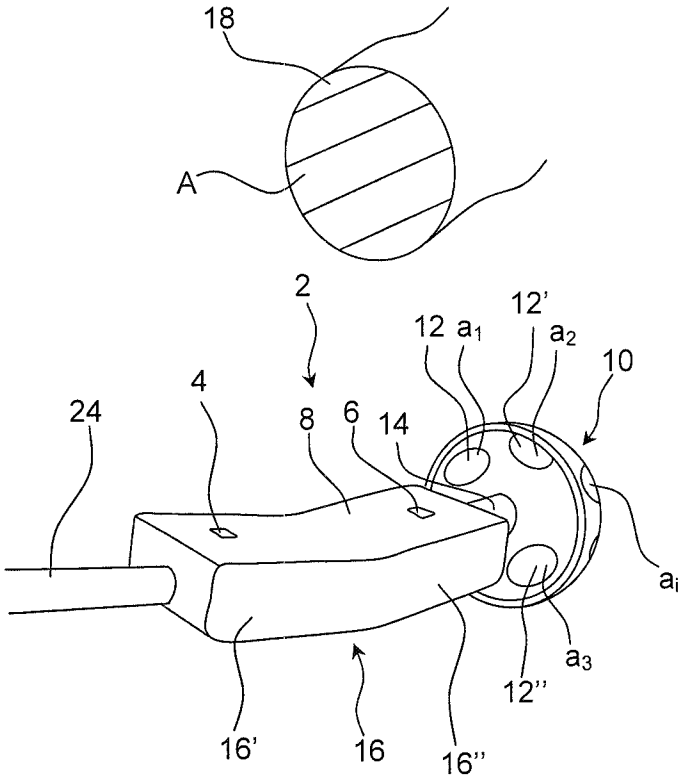
FIG. 6A shows a schematic perspective view of a hearing aid device according to the disclosure and FIG. 6B shows a schematic perspective view of the hearing aid device shown in FIG. 6A with a dome with ventilation apertures.
Figure 6A:
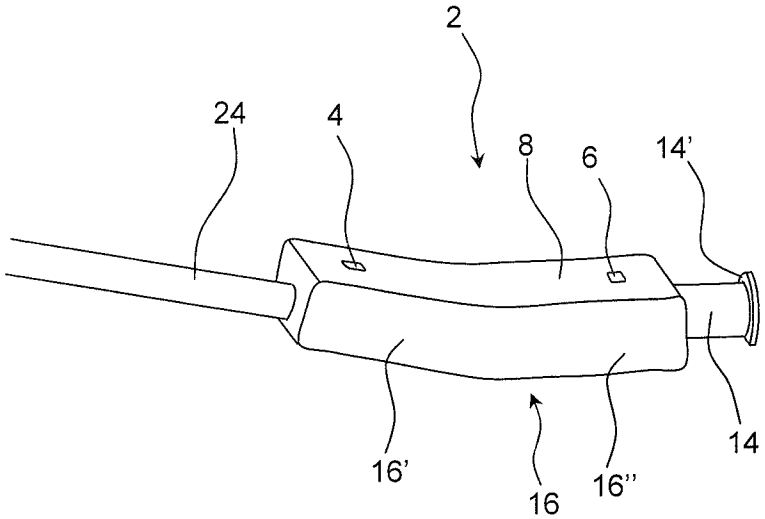

FIG. 6A illustrates a schematic perspective view of a hearing aid device 2 according to the disclosure. The hearing aid device 2 comprises a housing 16 having a first portion 16' and a second portion 16". Each of the two portions 16', 16" are basically box-shaped and the longitudinal axis X of the first portion 16' is angled relative to the longitudinal axis Y of the second portion 16" in order to make the hearing aid device 2 fit the anatomy of the ear canal 18.

A front microphone 4 is provided at the first portion 16' of the housing 16 of the hearing aid device 2. The second portion 16" of the housing 16 comprises a receiver 8, a rear microphone 6, battery (not shown), an amplifier (not shown) and a processing unit (not shown) configured to process the sound signals detected by the front microphone 4 and the rear microphone 6 according to a predefined processing scheme for the purpose of e.g. compensating for a hearing deficiency, while at the same time reducing the acoustic feedback. The hearing aid device 2 comprises a receiver 8 and rear microphone 6 that are integrated in the same unit. The front and rear microphones and the receiver are thus not located on a straight line (but reflect the angle between axes X and Y).

A pull-out string 24 extends as an extension of the proximal end of the first portion 16' of the housing 16 of the hearing aid device 2 and a pipe shaped cylindrical attachment member 14 extends as extension of the distal end of the second portion 16" of the housing 16 of the hearing aid device 2. The attachment member 14 is provided with an annular attachment flange 14'. The attachment member 14 is intended to be mechanically fixed to a dome 10 as illustrated in FIG. 6B.

FIG. 6B illustrates a schematic perspective view of the hearing aid device 2 shown in FIG. 6A. A dome 10 provided with a plurality of ventilation apertures 12, 12', 12" configured to provide ventilation in order to prevent occlusion is attached to the attachment member 14. The ventilation apertures 12, 12', 12" have ventilation areas of $a_1$, $a_2$, $a_3$ while $a_i$ is the area of the i'th ventilation aperture.

Above the hearing aid device 2 in FIG. 6B, the ear canal 18 is schematically shown and an exemplary cross-sectional area A of it is indicated (corresponding to the (axial) location of the dome with ventilation areas of $a_1$, $a_2$, . . . , $a_i$ in the ear canal).

LIST OF REFERENCE NUMERALS

2—Hearing aid device
4, 4'—Microphone

6, 6'—Microphone
8—Receiver
10—Dome
12, 12', 12"—Ventilation aperture
14—Attachment member
14' Attachment flange
16—Housing
16'—First portion of the housing
16" Second portion of the housing
18—Ear canal
20—Ear
22—Eardrum
24—Pull-out string
26—Sound waves
28—Outwards direction
30—Inwards direction
32, 34—Sound waves
36—Diagram (cardioid)
38—Diagram (omni-directional)
40—Directional chart
42—Graph
44—Noise (dB)
46—Far field (external sound)
48—Near field (feedback)
50 Feedback sound source
52—Summation circuit
54, 56, 58, 60—Connection
62, 64, 66, 68—Connection
70, 72, 74, 76—Connection
F—Frequency
DSP—Digital signal processor
$g_1$—Amplifier
$g_2$—Amplifier
d—Delay unit
FB—Feedback unit
X—Longitudinal axis
Y—Longitudinal axis
$a_1$, $a_2$, $a_3$, $a_i$—Ventilation area
A—Cross-sectional area of the ear canal

The invention claimed is:

1. A hearing aid device, comprising:

a receiver configured to be arranged in the ear canal;

a directional microphone comprising two microphones, termed a front and a rear microphone, respectively, or one microphone having two sound inlets, termed a front and a rear sound inlet, respectively;

a feedback suppression system for counteracting acoustic feedback on the basis of sound signals detected by the directional microphone;

an open fitting providing ventilation, wherein the two microphones or the two different sound inlets of the directional microphone are arranged in the ear canal at the same side of the receiver and sound is allowed to propagate between the microphones or between the inlets of the directional microphone and the receiver, the hearing aid device further comprises a mould or a housing provided with the front microphone and the rear microphone, the mould or housing being configured to be inserted into the ear canal in such a way that the receiver or the sound outlet of the receiver is arranged closer to the eardrum than the rear microphone or the rear sound inlet, and that the rear microphone or the rear sound inlet, is arranged between the receiver and the front microphone or the front sound inlet, and the microphones or sound inlets are spatially positioned relative to each other to provide that the acoustic feedback received at the rear microphone or the rear sound inlet exceeds the acoustic feedback received at the front microphone or the front sound inlet by at least 3 dB, when the hearing aid device is arranged in a normal ear canal.

2. A hearing aid device according to claim 1 wherein the feedback suppression system comprises a delay unit for delaying the rear microphone signal picked up by the rear microphone and a combination unit for subtracting the delayed rear microphone signal from the front microphone signal picked up by the front microphone.

3. A hearing aid device according to claim 1 wherein the open fitting providing ventilation is implemented in that the hearing aid device comprises a dome or an ear mould provided with one or more ventilation apertures, where the sum of the cross-sectional area(s) of the ventilation apertures is at least 5% of the cross-sectional area of the ear canal so that:

$$\sum_i a_i \geq 0.05A, \tag{1}$$

where $a_i$ is the cross-sectional area of the i'th ventilation aperture and where A is the cross-sectional area of the ear canal.

4. A hearing aid device according to claim 1, further comprising:

a dome or an ear mould; and the front microphone and the rear microphone, wherein the rear microphone is arranged on the inner side of the dome or the ear mould, and the rear microphone is arranged adjacent to the receiver.

5. A hearing aid device according to claim 1, wherein the hearing aid device comprises the rear microphone and the receiver that are integrated in one unit.

6. A hearing aid device according to claim 1, wherein the hearing aid device comprises a housing having a first portion and a second portion, where each of the two portions are basically box-shaped or cylindrical and where the longitudinal axis of the first portion is angled relative to the longitudinal axis of the second portion and where the housing has a geometry that fits the anatomy of the ear canal.

7. A hearing aid device according to claim 6, wherein the first portion comprises the front microphone and the rear microphone, and the receiver is housed in the second portion.

8. A hearing aid device according to claim 6, wherein the front and rear microphones and the receiver are not located on a common straight line, but reflect the angle between first and second portion of the housing.

9. A hearing aid device according to claim 1, wherein the hearing aid device comprises the rear microphone and the front microphone, and the hearing aid device is configured for attenuating the signal picked up by the rear microphone 3 dB or more relative to the signal picked up by the front microphone.

10. A hearing aid device according to claim 1, wherein the hearing aid device comprises:

a directional system comprising two microphones or the directional microphone comprising two sound inlets; and a processing unit configured to execute a procedure for optimising the directional system of the hearing aid device.

11. A hearing aid device, comprising:

a receiver configured to be arranged in the ear canal;

a directional system including two microphones, termed a front and a rear microphone, respectively, or one directional microphone having two sound inlets, termed a front and a rear sound inlet, respectively;

a processing unit configured to execute a procedure for optimising said directional system;

a feedback suppression system for counteracting acoustic feedback on the basis of sound signals detected by the directional microphone;

an open fitting providing ventilation, wherein the two microphones or the two different sound inlets of the directional microphone are arranged in the ear canal at the same side of the receiver and sound is allowed to propagate between the microphones or between the inlets of the directional microphone and the receiver, the hearing aid device further comprises a mould or a housing provided with the front microphone and the rear microphone, the mould or housing being configured to be inserted into the ear canal in such a way that the receiver or the sound outlet of the receiver is arranged closer to the eardrum than the rear microphone or the rear sound inlet, and that the rear microphone or the rear sound inlet, is arranged between the receiver and the front microphone or the front sound inlet, and the microphones or sound inlets are spatially positioned relative to each other to provide that the acoustic feedback received at the rear microphone or the rear sound inlet exceeds the acoustic feedback received at the front microphone or the front sound inlet by at least 3 dB, when the hearing aid device is arranged in a normal ear canal, the processing unit is configured to play a sound signal from the receiver and thereby detect a level difference between the two microphones or the two sound inlets, in order to provide a level match, where the same sound signal is used to detect a delay difference between the two microphones or the two sound inlets of the directional microphone.

12. A hearing aid device according to claim 10, wherein the processing unit for optimising the directional system of the hearing aid device is configured to use a feedback unit to estimate a transfer function of an emitted signal from the receiver to the received signal from each microphone input, or to the received signal from each sound inlet, to estimate the difference in both sound level and delay and/or phase.

13. A hearing aid device according to claim 10, wherein the processing unit is configured to optimise the directional system of the hearing aid device by detecting the signal power in the directional microphone signal and minimising the total power in the directional microphone signal.

14. A hearing aid device according to claim 10, wherein the procedure of optimising the directional system is dynamic.

15. A hearing aid device according to claim 10, wherein the hearing aid device is configured to optimise the directional system of the hearing aid device in predefined or adaptively determined frequency bands.

16. The hearing aid device according to claim 5, wherein the rear microphone and the receiver are integrated into a one piece body.

17. The hearing aid device according to claim 10, wherein the processing unit for executing the procedure for optimising the directional system of the hearing aid device is configured to play a sound from the receiver and thereby detect a level difference between the two microphones or the two sound inlets, in order to provide a level match, where said sound is also used to detect a delay difference between the two microphones or the two sound inlets of the directional microphone.

18. The hearing aid device according to claim 11, further comprising:

a housing having a first portion and a second portion, each of the two portions being substantially box-shaped or cylindrical, wherein the longitudinal axis of the first portion is angled relative to the longitudinal axis of the second portion.

19. The hearing aid device according to claim 18, wherein the front and rear microphones and the receiver are not located on a common straight line, but reflect the angle between first and second portion of the housing.

20. The hearing aid device according to claim 11, wherein the sound signal comprises at least one of:

a pure tone;

a swept tone; and a broad-band noise.

* * * * *